United States Patent [19]

Sills

[11] 4,286,445

[45] Sep. 1, 1981

[54] PADLOCK PROTECTIVE COVER

[76] Inventor: William G. Sills, R.F.D. 2, Medina, N.Y. 14103

[21] Appl. No.: 63,520

[22] Filed: Aug. 3, 1979

[51] Int. Cl.[3] ..... E05B 67/38

[52] U.S. Cl. ..... 70/55; 70/455

[58] Field of Search ..... 70/54, 55, 56, 417, 70/455; 150/0.5, 52 R; 249/92, 97, 121

[56] References Cited

U.S. PATENT DOCUMENTS

| | | | |
|---|---|---|---|
| 1,318,652 | 10/1919 | Farkas | 24/205 R |
| 1,662,612 | 3/1928 | Junkune | 70/55 |
| 3,858,419 | 1/1975 | Hampton | 70/55 |

FOREIGN PATENT DOCUMENTS

| | | | |
|---|---|---|---|
| 154804 | 10/1938 | Austria | 70/55 |

*Primary Examiner*—Robert L. Wolfe

*Attorney, Agent, or Firm*—Jack C. Munro

[57] ABSTRACT

A padlock protective cover which is constructed of flexible sheet material comprising a soft plastic. Within the housing of the cover is located a pair of spaced-apart openings through which is to be conducted the shackle portion of the padlock. The body portion of the padlock is to be located interiorly of the housing. An enlarged access opening is to be provided into the interior chamber. Closing means for the access opening is to be provided in the form of a zipper or in the form of a hinged panel.

1 Claim, 8 Drawing Figures

PADLOCK PROTECTIVE COVER

BACKGROUND OF THE INVENTION

The field of this invention relates to protective devices, more particularly to a protective device for a padlock to protect such against foreign materials such as moisture and dirt that can cause the padlock to become inoperative.

Padlocks are frequently used in the outdoors. This means that the padlock is to be subjected to undesirable conditions, such as rain, snow, dirt, wind and other undesirable conditions which may cause the padlock to become unoperative after a short period of time. This is especially true in the combination type of padlock.

There is a definite need for a protective cover of some type which can be readily and quickly placed over a padlock when it is known that the padlock is going to be exposed to undesirable conditions. Previous to this invention, there has not been known a protective cover for a padlock which can be readily purchased, placed over a padlock when it is known that the padlock is going to be subjected to undesirable conditions. A protective cover should not permit entry of moisture or dust into the padlock.

SUMMARY OF THE INVENTION

The structure of this invention is summarily described in the Abstract of the Disclosure and reference is to be had thereto.

The primary objective of this invention is to construct a protective cover for a padlock which can be readily placed about a conventional padlock structure which will protect the padlock from moisture and dust which can cause a padlock to become inoperative.

DETAILED DESCRIPTION OF THE SHOWN EMBODIMENTS

Figure 1:
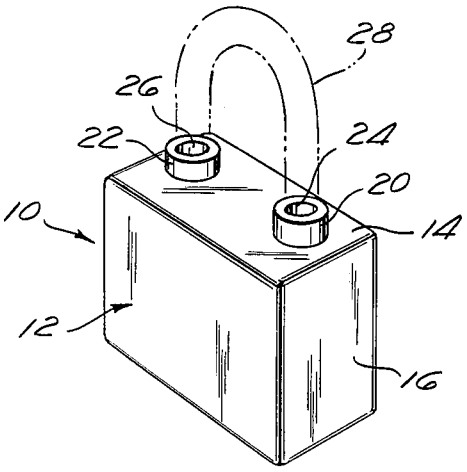
FIG. 1 is a top isometric view of the first embodiment of the protective cover of this invention.
Figure 2:
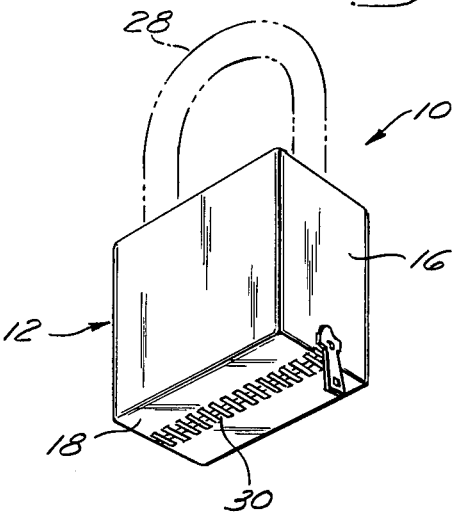
FIG. 2 is a bottom isometric view of the first embodiment of the protective cover of this invention.

Referring particularly to the drawings, there is shown in FIGS. 1 and 2 the first embodiment of protective cover 10 of this invention taking the form of an enclosed housing 12 which is formed generally of a top panel 14, a side wall assembly 16 and a bottom panel 18. It is to be understood that the enclosed housing 12 will be entirely constructed in an integral manner with a sheet of a flexible sheet material. A preferable type of material would be either a polyethylene or a polystyrene plastic. However, it is also to be considered within the scope of this invention to use rubber or other similar types of material.

Within the top panel 14 there is located annular protrusions 20 and 22. Within the annular protrusion 20 is located an opening 24 and within the annular protrusion 22 is located an opening 26. The shackle 28 of a padlock (not shown) is to be passed through the openings 24 and 26 to assume the position shown in dotted lines within FIGS. 1 and 2. It is to be understood that the shackle 28, in the position shown in FIGS. 1 and 2, that the padlock is locked.

In order to gain access into the interior chamber of the housing 12, there is provided a conventional zipper assembly 30. The zipper 30 is of sufficient length so as to provide entry of the entire body portion of the padlock to within the interior chamber of the housing 16.

It is to be understood that the padlock is to be in the unlocked position prior to placing the protective cover 10 upon the padlock. Initially, the free end of the shackle 28 is to be passed through one of the openings 24 or 26 and then the housing 12 is to be inserted over the body portion of the padlock. Once completely inserted, the zipper 30 can be closed. In order to effect operation of the padlock, the zipper 30 is to be opened and the key which is to operate the padlock is to be connected with the padlock in the normal manner.

Figure 3:
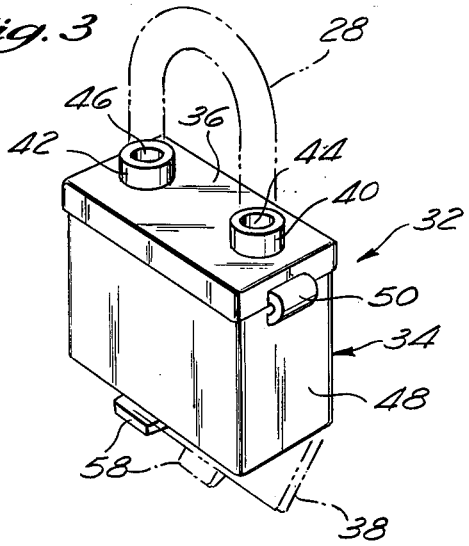
FIG. 3 is a top isometric view of the second embodiment of the protective cover of this invention.
Figure 4:
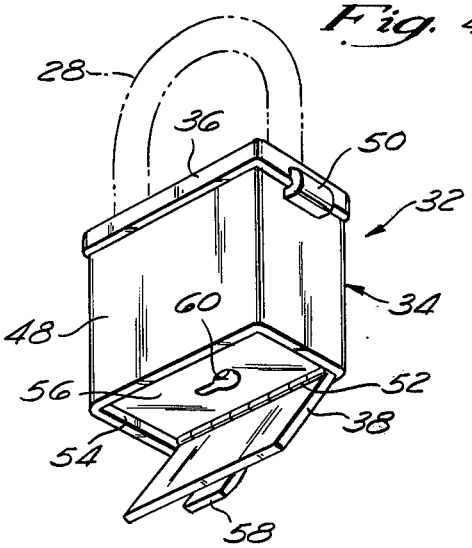
FIG. 4 is a bottom isometric view of the second embodiment of the protective cover of this invention showing the bottom panel in the open position to permit entry into the interior chamber of the protective cover housing.

Referring particularly to FIGS. 3 and 4 there is shown the second embodiment 32 of protective cover of this invention. The second embodiment 32 takes the form of an enclosed housing 34 which has a top panel 36 and a bottom panel 38. The top panel 36 in a similar manner includes annular protuberances 40 and 42 which have openings 44 and 46 therein, respectively, which are to connect with the shackle 28.

The difference between the structure in FIGS. 3 and 4 and FIGS. 1 and 2 is that the top panel 36 is disconnectable from the side wall section 48 of the enclosed housing 34. A connecting section of plastic 50 connects the top 36 to the side wall assembly 48 and prevents total disassociation therebetween. The bottom panel 38 is hingedly connected through a conventional piano type hinge 52 to the side wall assembly 48. The bottom panel 38 permits access into the interior chamber 54 of the enclosed housing 34. The main body portion 56 of the padlock is to be located within the interior chamber 54. A protruding tab 58 is connected to the bottom panel 38 to facilitate opening and closing of such to permit connection with a key (not shown) into the key opening 60 formed within the body portion 56.

Figure 5:
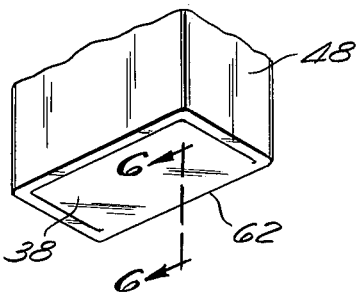
FIG. 5 is a partial isometric view of the bottom section of a modified form of the protective cover shown in FIGS. 3 and 4 with the bottom panel in the closed position.
Figure 6:
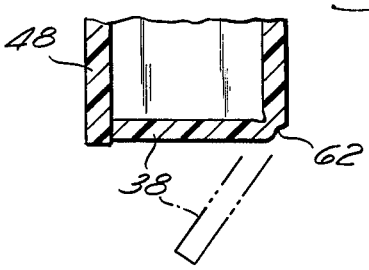
FIG. 6 is a cross-sectional view taken along line 6—6 of FIG. 5.

Referring particularly to FIGS. 5 and 6, the piano hinge could be eliminated, and instead a "living hinge" 62 could be employed in the form of an integral piece of plastic interconnecting bottom panel 38 and side wall assembly 48 along one edge thereof.

Figure 7:
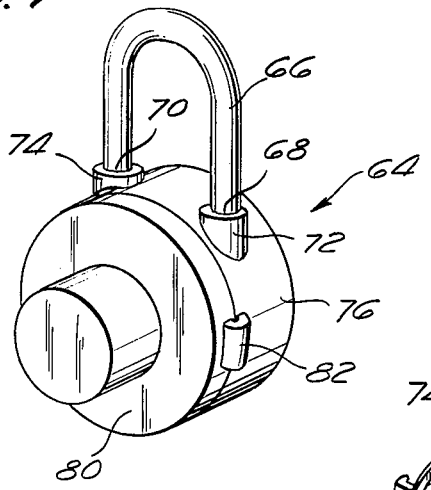
FIG. 7 is a isometric view of a third embodiment of the protective cover of this invention designed in particular to accommodate the combination type of lock.
Figure 8:
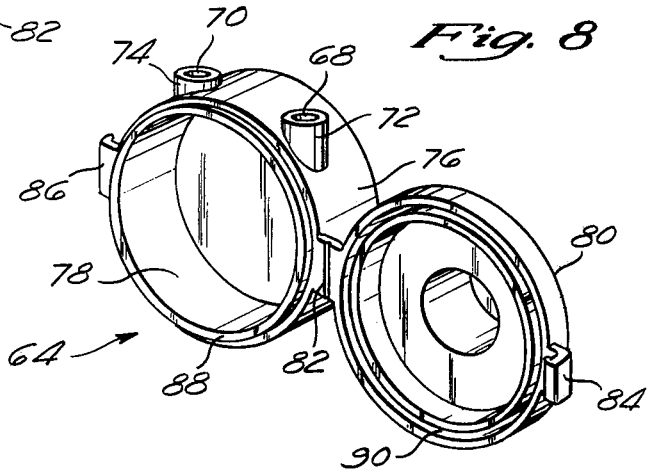
FIG. 8 is a isometric view of the third embodiment of FIG. 7 showing the housing in the open position.

Referring particularly to FIGS. 7 and 8, there is shown the third embodiment 64 of protective cover of this invention which is designed in particular to be employed in conjunction with a conventional combination type of padlock. The conventional combination type padlock employs a shackle 66 which is to be conducted through openings 68 and 70 formed within respectively annular protuberances 72 and 74. The protuberances 72 and 74 are integrally formed on the enclosed housing 76. The enclosed housing 76 includes an interior chamber 78 which is to accommodate the body portion of the padlock.

The front wall 80 is to be hingedly connected to the enclosed housing 76 through a connecting member 82. When in the closed position, locking tabs 84 and 86 lock together in order to prevent unauthorized opening movement of the front wall 80. An annular rim 88 is formed about the access opening into chamber 78. This rim 88 is to snughly engage an annular groove 90 formed within the inside surface of the front wall 80. This is to help prevent the entry of moisture and dust to the confines of the chamber 78 when the front wall 80 is in the locked position.

It is to be understood that the inserting of the padlock within the second and third embodiment of this invention is to be accomplished in a manner similar to the first embodiment.

What is claimed is:

1. A padlock protective cover comprising:

an enclosed housing including a side wall assembly constructed of flexible sheet material, said side wall assembly having an upper access opening and a lower access opening each of which connects with an interior chamber, said interior chamber adapted to contain the body portion of a padlock;

a top hingedly connected by a first "living hinge" assembly to said side wall assembly, said top capable of tightly connecting with said side wall assembly to close said upper access opening, said top having a pair of spaced-apart aperatures, said aperatures to connect with the shackle portion of a padlock, a separate annular protuberance integrally attached to said top and extending outwardly therefrom, a said annular protuberance being located about said aperture, whereby each said annular protuberance is to tightly connect with the shackle portion of the padlock;

a bottom hingedly connected by a second "living hinge" to said side wall assembly, said bottom being movable to close said lower access opening, said bottom being located entirely within said internal chamber and in snug contact with the wall of said internal chamber when said bottom is closing said access opening; and a tab attached to said bottom and protruding outwardly from said side wall assembly when said bottom is in the closed position, said tab to facilitate manual hinging movement of said bottom.

* * * * *